US006967572B1

(12) United States Patent
Oladeinde

(10) Patent No.: US 6,967,572 B1
(45) Date of Patent: Nov. 22, 2005

(54) RADIATOR CAP HAVING READOUT CAPABILITIES

(76) Inventor: Dada O. Oladeinde, 25013 Whitman St., Apt. 9 South, Hayward, CA (US) 94544

( * ) Notice: Subject to any disclaimer, the term of this patent is extended or adjusted under 35 U.S.C. 154(b) by 123 days.

(21) Appl. No.: 10/740,267

(22) Filed: Dec. 19, 2003

(51) Int. Cl.[7] ..... B60Q 1/00
(52) U.S. Cl. ..... 340/451; 340/618; 340/450; 220/200; 374/146
(58) Field of Search ..... 340/451, 450.3, 340/450, 618, 626; 220/200, 288, 203.06; 116/28 R, 109; 374/146

(56) References Cited

U.S. PATENT DOCUMENTS 1,410,567 A * 3/1922 Harris ..... 374/146
1,455,043 A * 5/1923 Cameron ..... 374/146
3,338,457 A * 8/1967 Tygenhof ..... 116/227
3,910,451 A * 10/1975 Tusing ..... 220/203.26
3,934,671 A 1/1976 Hart
3,986,110 A 10/1976 Overall et al.
4,107,493 A * 8/1978 Nagara et al. ..... 200/84 C
4,231,025 A * 10/1980 Turner, Jr. ..... 340/521
4,241,845 A * 12/1980 Daly et al. ..... 220/203.26
4,459,046 A 7/1984 Spirg
4,691,669 A * 9/1987 Otteman et al. ..... 123/41.15
4,891,252 A 1/1990 Kaiser, Jr.
5,303,585 A 4/1994 Lichte
D348,017 S 6/1994 Poleshuk et al.
5,656,771 A * 8/1997 Beswick et al. ..... 73/118.1
5,741,069 A * 4/1998 Egel ..... 374/146
D399,177 S 10/1998 Perry
2005/0092734 A1 * 5/2005 Lerner ..... 219/445.1

* cited by examiner

*Primary Examiner*—Jeffery Mofsass
*Assistant Examiner*—Eric Blount
(74) *Attorney, Agent, or Firm*—Donald R. Schoonover

(57) ABSTRACT

A radiator cap for use with a fluid cooling circuit associated with an engine, such as an automobile engine, includes elements that monitor various conditions in the radiator and provides a readout of such conditions. A circuit that has an audible signal is also included in the cap.

2 Claims, 1 Drawing Sheet

RADIATOR CAP HAVING READOUT CAPABILITIES

BACKGROUND OF THE INVENTION

1. Field of the Invention

The present invention relates to the general art of measuring and testing, and to the particular field of measuring devices for monitoring the conditions of elements of a vehicle engine.

2. Discussion of the Related Art

Vehicles, such as land vehicles, are generally powered by internal combustion engines. These engines often generate great quantities of heat that must be dissipated. If the heat is not properly dissipated, the engine could be damaged.

One common means for dissipating heat from such engines includes a fluid flow circuit. Fluid, generally water, is circulated through the engine to absorb heat generated by the engine.

This is a very effective means for controlling the temperature of such engines. However, a problem that has occurred in the past is the loss of fluid from the cooling circuit. Many engines include a radiator through which the fluid in the cooling circuit flows. The conditions of the fluid in the cooling circuit can often be monitored in the radiator. Thus, for example, fluid level and various fluid state properties can be monitored in the radiator.

While the art does contain various devices for monitoring temperature of fluid in the engine cooling circuit, the inventor is not aware of any device or system that will not only monitor such fluid properties as fluid level, temperature and pressure, but will also alert the engine operator of the fluid conditions.

Therefore, there is a need for a device and system for monitoring a fluid in a cooling circuit of an engine, such as an internal combustion engine.

Still further, while monitoring the conditions of fluid in a cooling circuit of an engine is helpful, it will be more helpful if the engine operator is alerted to conditions that may be outside of specified parameters, such as low fluid level or high temperature, or the like.

Therefore, there is a need for a device and system for monitoring a fluid in a cooling circuit of an engine, such as an internal combustion engine and which will alert an operator of conditions that may be outside of specified ranges.

Further to alerting an operator of conditions that may be outside of specified values, it will be helpful if the operator can see how far out of specified ranges the fluid conditions in the cooling circuit are. In such a case, the operator may be able to postpone attention to the engine. Obviously, some conditions may require immediate attention, while others may not need such immediate attention. It may be dangerous to the engine if attention is not paid to those conditions requiring immediate attention, but it may be wasteful of time and money to immediately attempt to remedy conditions that can wait. Furthermore, some engine operators know their engines so well that they will understand when to wait and when to provide immediate care to the engine. Thus, it will be helpful if the level of the conditions existing in the fluid circuit is presented to the operator.

Therefore, there is a need for a device and system for monitoring a fluid in a cooling circuit of an engine, such as an internal combustion engine and which will alert an operator of conditions that may be outside of specified ranges and which can also provide a reading of the level of the conditions being monitored.

In some instances, an operator of an engine, such as an automobile engine, may not be in a position to monitor the conditions in the fluid cooling circuit. This may be the situation where the engine operator is inexperienced or inattentive, which often happens if the engine is in an automobile.

Therefore, there is a need for a device and system for monitoring a fluid in a cooling circuit of an engine, such as an internal combustion engine and which will alert an operator of conditions that may be outside of specified ranges and can do so in a manner that will alert an inattentive operator of the condition.

If a fluid system monitoring system is complicated, it may not be amenable to retrofitting onto an existing vehicle. This may inhibit the commercial success of the system.

Therefore, there is a need for a device and system for monitoring a fluid in a cooling circuit of an engine, such as an internal combustion engine and which will alert an operator of conditions that may be outside of specified ranges and can do so in a manner that will alert an inattentive operator of the condition yet will be simple and amenable to easy retrofitting to an existing vehicle.

PRINCIPAL OBJECTS OF THE INVENTION

It is a main object of the present invention to provide a device and system for monitoring a fluid in a cooling circuit of an engine, such as an internal combustion engine.

It is another object of the present invention to provide a device and system for monitoring a fluid in a cooling circuit of an engine, such as an internal combustion engine and which will alert an operator of conditions that may be outside of specified ranges.

It is another object of the present invention to provide a device and system for monitoring a fluid in a cooling circuit of an engine, such as an internal combustion engine and which will alert an operator of conditions that may be outside of specified ranges and which can also provide a reading of the level of the conditions being monitored.

It is another object of the present invention to provide a device and system for monitoring a fluid in a cooling circuit of an engine, such as an internal combustion engine and which will alert an operator of conditions that may be outside of specified ranges and can do so in a manner that will alert an inattentive operator of the condition.

It is another object of the present invention to provide a device and system for monitoring a fluid in a cooling circuit of an engine, such as an internal combustion engine and which will alert an operator of conditions that may be outside of specified ranges and can do so in a manner that will alert an inattentive operator of the condition yet will be simple and amenable to easy retrofitting to an existing vehicle.

SUMMARY OF THE INVENTION

These, and other, objects are achieved by a cap for a radiator that is electrically coupled to a fluid condition-measuring circuit in the radiator. The cap has readout elements thereon which can be quickly and easily read by the engine operator. The readout elements will provide a reading of various conditions in the fluid in the engine cooling circuit. These conditions include fluid level, temperature and the like. The radiator cap of the present invention also includes a circuit that has an audible alarm whereby an engine operator can be audibly alerted to a condition in the fluid circuit.

Using the radiator cap embodying the present invention will permit an engine operator to quickly determine various conditions of the fluid in the engine cooling circuit so any conditions that are out of specifications can be quickly identified. The radiator cap will also present the data in a manner that will permit the engine operator to determine if immediate attention must be given to the fluid circuit, or if such attention can be postponed. The radiator cap of the present invention also has an alarm circuit that will generate an audible signal when conditions in the fluid cooling circuit reach certain levels so that an inattentive engine operator will be alerted to an unusual condition.

The radiator cap embodying the present invention is self-contained and can be easily retrofit onto an existing vehicle.

BRIEF DESCRIPTION OF THE DRAWING FIGURES

DETAILED DESCRIPTION OF THE PREFERRED EMBODIMENT

Figure 2:
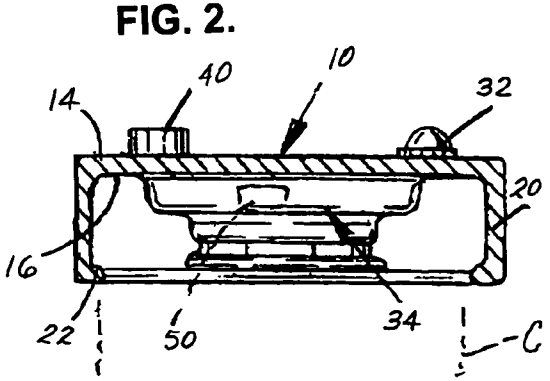
FIG. 2 is an elevational view taken along line 2—2 of FIG. 1.
Figure 1:
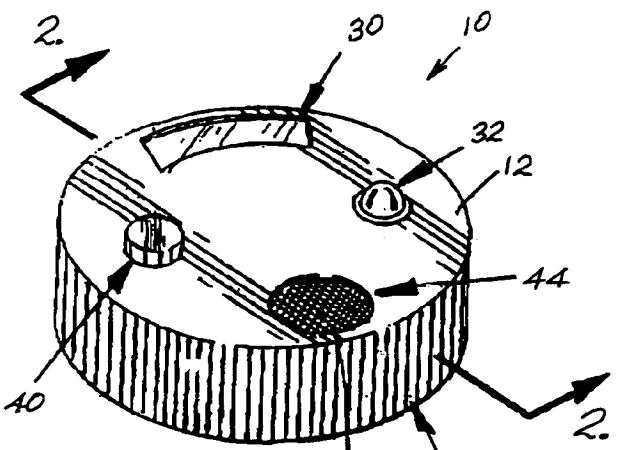
FIG. 1 is a perspective view of a radiator cap embodying the present invention.

Other objects, features and advantages of the invention will become apparent from a consideration of the following detailed description and the accompanying drawings.

Referring to the Figures, it can be understood that the present invention is embodied in a radiator cap 10.

Radiator cap 10 includes a body 12 that adapted to fit over a filling conduit C of a radiator R used in a fluid cooling circuit of an internal combustion engine such as a land vehicle or the like. Body 12 includes a first surface 14 that is an outside surface when the body 12 is in a use position on the filling conduit of the radiator, a second surface 16 that is an inside surface when the body 12 is in a use position on the filling conduit of the radiator, and a skirt 20 that is adapted to engage the filling conduit to hold the body 12 in place on the filling conduit. Skirt 20 can include an annular flange 22 so the body 12 can simply be screwed onto the radiator filling conduit or otherwise easily placed onto the filling conduit.

A water level readout window 30 is located in the body 12 and is located to be easily read with the cap 10 in place on the filling conduit.

An LED signal generator 32 is located on the body 12 and is located to be easily read and easily visible when the cap 10 is in place on the filling conduit. Signal generator 32 can be a flashing light or the like and has the circuit and power source associated therewith located in a housing 34 on the inside surface of the cap 10. It is noted that housing 34 contains all of the circuitry and power sources required for the various circuits and systems described herein.

A reset button 40 is also located on the body 12 and is electrically connected to the circuitry contained in housing 34. The reset button 40 is used after filling the radiator or the like.

An audible alarm signal generator 44 is located on the body 12 and includes a speaker 46 which is controlled and powered by the circuitry and systems in housing 34. Since all of the monitoring systems of the radiator cap 10 are in or on the cap itself, the monitoring system can be easily installed, and a retrofit onto an existing vehicle is easy and quick.

An electrical circuit 50 is electrically connected to the LED signal generator 32 and to the reset button 40 and to the audible alarm signal generator 44. Circuit 50 also includes a level sensing circuit 52 that is adapted to sense the level of fluid in the radiator and which will generate a signal associated with the level of fluid in the radiator, the signal being sent to the water level readout window 30 and to the LED signal generator 32 and to the audible alarm 44 to activate the water level readout window 30 and the LED signal generator 32 and the audible alarm 44 when fluid conditions in the radiator reach pre-set levels.

Figure 3:
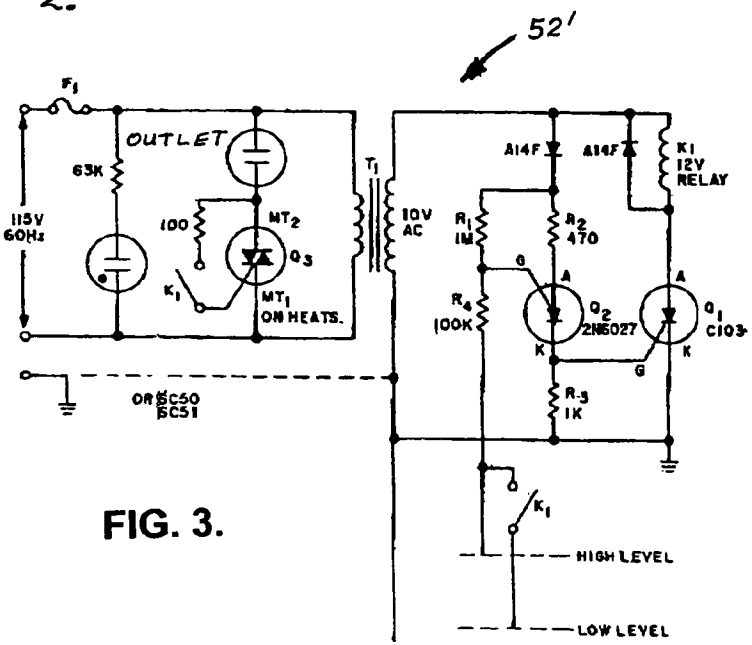
FIG. 3 is a diagram of a circuit that can be used to monitor conditions in a radiator of the engine of a vehicle.

A circuit that is suitable for use with the radiator cap 10 of the present invention is shown in FIG. 3 as circuit 52'. It is understood that the circuit shown in FIG. 3 is an example of the type of circuit that can be used and using the teaching of the present disclosure, those skilled in the art will be able to design other circuits that can be used without exercising invention. Circuit 52' shown in FIG. 3 may require modification of an existing radiator; however, such modification may be quite easily effected. However, using the teaching of the present disclosure, those skilled in the art will understand how to incorporate a fluid level monitoring sensor into the radiator cap body itself whereby the entire monitoring system is contained in the radiator cap so the fluid conditions in an engine cooling system can be monitored by systems entirely contained in the radiator cap itself. Accordingly, the specific details of the circuitry will not be disclosed.

Circuit 52' shown in FIG. 3 is an example of a circuit that can be used in the cap embodying the present invention. Circuit 52' monitors fluid level in an engine cooling system between two fixed points so the fluid level in the cooling system does not become too high or too low. Two modes are possible by simple reversing the contact connections K1. Liquid level detection is accomplished by two metal probes, one measuring the high level and the other the low level. An inversion of the logic can be accomplished by replacing the normally open contact on the gate of Q3 with a normally closed *contact*.

It is understood that while certain forms of the present invention have been illustrated and described herein, it is not to be limited to the specific forms or arrangements of parts described and shown.

What is claimed is:

1. A radiator cap comprising:

a) a body that is adapted to fit over a filling conduit of a radiator used in a fluid cooling circuit of an internal combustion engine, said body including (1) a first surface that is an outside surface when said body is in a use position on the filling conduit of the radiator, (2) a second surface that is an inside surface when said body is in a use position on the filling conduit of the radiator, and (3) a skirt that is adapted to engage the filling conduit to hold said body in place on the filling conduit;

b) a water level readout window in said body;

c) an LED signal generator on said body;

d) a reset button on said body;

e) an audible alarm signal generator on said body, said audible alarm signal generator having a speaker mounted on said body; and f) an electrical circuit electrically connected to said LED signal generator and to said reset button and to said audible alarm signal generator and including a level sensing circuit that is adapted to sense the level of fluid in the radiator and which will generate a signal associated with the level of fluid in the radiator, the signal being sent to said water level readout window and to said LED signal generator and to said audible alarm to activate said water level readout window and said LED signal generator and said audible alarm when fluid conditions in the radiator reach pre-set levels.

2. A radiator cap comprising:

a) a body;

b) a water level readout window in said body;

c) an LED signal generator on said body;

d) a reset button on said body;

e) an audible alarm signal generator on said body, said audible alarm signal generator having a speaker mounted on said body; and f) an electrical circuit electrically connected to said LED signal generator and to said reset button and to said audible alarm signal generator and including a level sensing circuit that is adapted to sense the level of fluid in the radiator and which will generate a signal associated with the level of fluid in the radiator, the signal being sent to said water level readout window and to said LED signal generator and to said audible alarm to activate said water level readout window and said LED signal generator and said audible alarm when fluid conditions in the radiator reach pre-set levels.

* * * * *